United States Patent [19]

Shanelec

[11] Patent Number: 4,936,053

[45] Date of Patent: Jun. 26, 1990

[54] LAWN MOWER BLADE SHARPENER APPARATUS

[76] Inventor: Will Shanelec, 303 E. 11th St., Ellsworth, Kans. 67439

[21] Appl. No.: 257,973

[22] Filed: Oct. 14, 1988

[51] Int. Cl.[5] ..... B24B 3/00; B24B 41/06; B24B 47/02; B23Q 1/00

[52] U.S. Cl. ..... 51/92 BS; 51/217 A; 51/231; 51/217 P; 269/45

[58] Field of Search ..... 51/92 BS, 94 R, 93, 51/98 BS, 217 R, 217 T, 218 A, 218 R, 224, 231, 216 A, 222, 217 A, 241 G, 247, 91 BS, 27 P; 269/249, 37, 45

[56] References Cited

U.S. PATENT DOCUMENTS

| | | | |
|---|---|---|---|
| 845,487 | 2/1907 | Strehl | 51/247 X |
| 1,385,649 | 7/1921 | Sherman | 51/218 R |
| 1,973,238 | 11/1933 | Walter | 51/217 R |
| 3,733,751 | 5/1973 | Williams | 51/224 X |

*Primary Examiner*—Frederick R. Schmidt
*Assistant Examiner*—Bruce P. Watson
*Attorney, Agent, or Firm*—Phillip A. Rein

[57] ABSTRACT

This invention relates to a lawn mower blade sharpener apparatus readily attachable to a bench grinder assembly having a rotating grinder wheel to sharpen an edge portion on a lawn mower blade. The lawn mower blade sharpener apparatus includes (1) a stationary grinder attachment assembly being clamped to an object support assembly on the bench grinder assembly; and (2) a pair of movable blade attachment assemblies, each connectable to an outer opposite end of the lawn mower blade. Each movable blade attachment assembly is provided with a main support rod engagable with the stationary grinder attachment assembly and having a plurality of blade connector clamps secured to an outer blade section of the lawn mower blade. The movable blade attachment assemblies are longitudinally movable within the stationary grinder attachment assembly so as to move an outer edge portion of the outer blade sections of the lawn mower blade to be sharpened in a desired angular and longitudinal relationship relative to the rotating grinder wheel.

1 Claim, 2 Drawing Sheets

LAWN MOWER BLADE SHARPENER APPARATUS

PRIOR ART

A patent search on this invention revealed the following U.S. Patents:

| U.S. Pat. No. | Invention | Inventor |
|---|---|---|
| 270,790 | HOLDER FOR MOWER AND REAPER KNIVES | Jonathan R. Hamilton |
| 629,069 | MOWER KNIFE GRINDER | George H. Fowler |
| 779,698 | SICKLE SUPPORT FOR GRINDSTONES | Charles H. Ferguson |
| 1,119,723 | GRINDER | William S. Porter |
| 3,656,263 | ATTACHMENT FOR HOLDING A FORAGE KNIFE ON A GRINDING MACHINE | Julius A. Jacobsen |

The Hamilton patent discloses the combination of a grinding wheel and adjustable holder structure for blade sharpening purposes having means for adjusting a sharpening angle.

The Fowler and Porter patents describe blade grinder structures providing a holding structure necessary due to the large size and weight of the mowing machine blades being sharpened.

The Ferguson patent discloses a support structure holding a sickle blade on a support structure for sharpening purposes.

The Jacobsen patent discloses an attachment for holding a forage knife on a grinding machine for sharpening purposes. The blade is held in a desired inclined position through the use of roller and wheel structures having a pressure lever operable to bias a rubber wheel against the blade to be sharpened.

PREFERRED EMBODIMENT OF THE INVENTION

In one preferred embodiment of this invention, a lawn mower blade sharpener apparatus is operable to hold a lawn mower blade in a proper position for use with a bench grinder assembly to provide sharpening of cutting edges of the blade. The lawn mower blade sharpener apparatus includes (1) a stationary grinder attachment assembly releasably connectable to the bench grinder assembly; and (2) a pair of movable blade attachment assemblies respectively connectable to an outer portion of the lawn mower blade. The stationary grinder attachment assembly includes a main support tube having grinder clamp members secured thereto. The main support tube includes a main body section having an elongated longitudinal slot section to receive the movable blade attachment assemblies therein. The grinder clamp members are generally U-shape having threaded anchor members operable to be attached to an object support assembly of the bench grinder assembly in a fixed position. The movable attachment assemblies are substantially identical each having (1) a main support rod; and (2) a plurality of blade connector clamps secured to the main support rod. The main support rod includes a rod body of tubular shape in transverse cross section with a laterally extended anchor flange having the blade connector clamps secured thereto. The rod body is slidably movable within the main body section of the main support tube and having the anchor flange extended laterally of the slot section. The blade connector clamps are provided with first and second plate members and having anchor members extended through a threaded opening. The anchor members are adapted to be clamped against the lawn mower blade. The movable blade attachment assemblies are thereupon clamped on opposite ends of the lawn mower blade and adapted to be longitudinally and axially moved within the main support tube and provides the proper angular relationship between an edge to be sharpened and a grinder wheel of the bench grinder assembly.

OBJECTS OF THE INVENTION

One object of this invention is to provide a lawn mower blade sharpener attachment which can be readily connected to conventionally available bench grinder assemblies and having means for attaching to opposite ends of a lawn mower blade to hold same in a proper angular position relative to a grinder wheel on the bench grinder assembly and reciprocally move the lawn mower blade for sharpening purposes.

One further object of this invention is to provide a lawn mower blade sharpener apparatus including a stationary grinder attachment assembly readily connectable to an existing object support assembly on a bench grinder assembly and having a movable blade attachment assembly connected to a lawn mower blade and reciprocally movable within the stationary grinder attachment assembly for a blade sharpening operation.

One other object of this invention is to provide a lawn mower blade sharpener apparatus including a stationary grinder attachment assembly which is readily connected through grinder clamp members to a support plate on a bench grinder assembly; a movable blade attachment assembly attached to each opposite end of a lawn mower blade member through the use of blade connector clamps; and the movable blade attachment assemblies respectively movable within the stationary grinder attachment assembly in a longitudinal manner for a blade sharpening function.

Still, one further object of this invention is to provide a lawn mower blade sharpener apparatus which is economical to manufacture; substantially maintenance free; easy to use on existing bench grinder assemblies; readily attachable to various sizes and shapes of lawn mower blade members; and easy to operate.

Various other objects, advantages, and features of the invention will become apparent to those skilled in the art from the following discussion, taken in conjunction with the accompanying drawings, in which:

FIGURES OF THE INVENTION

Figure 1:
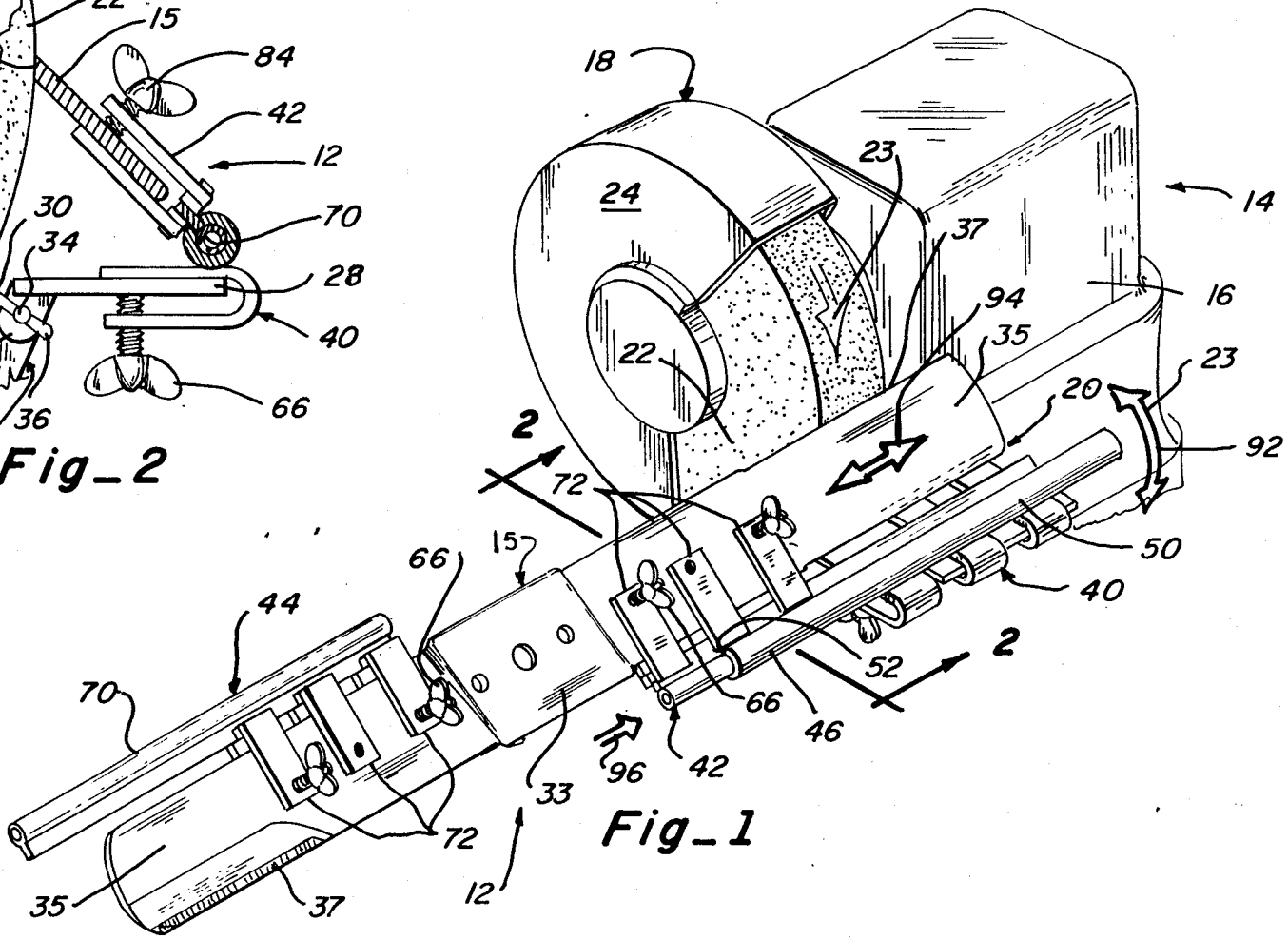
FIG. 1 is a perspective view of a lawn mower blade sharpener apparatuis of this invention mounted on a bench grinder assembly for sharpening of a lawn mower blade illustrated therewith.

The following is a discussion and description of preferred specific embodiments of the lawn mower blade sharpener apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings and, in particular to FIG. 1, a lawn mower blade sharpener apparatus of this invention, indicated generally at 12, is shown as attached to a bench grinder assembly 14 and having a lawn mower blade 15 connected thereto.

The bench grinder assembly 14 includes a drive motor member 16 connected to and operable to rotate a grinder wheel assembly 18 and having an object support assembly 20. The drive motor member 16 may be of a conventional 110 volt electrical type.

The grinder wheel assembly 18 includes a grinder wheel 22 driven in a clockwise position as noted in FIG. 1 as indicated by an arrow 23. Additionally, a grinder shield member 24 is provided for obvious safety purposes.

Figure 2:
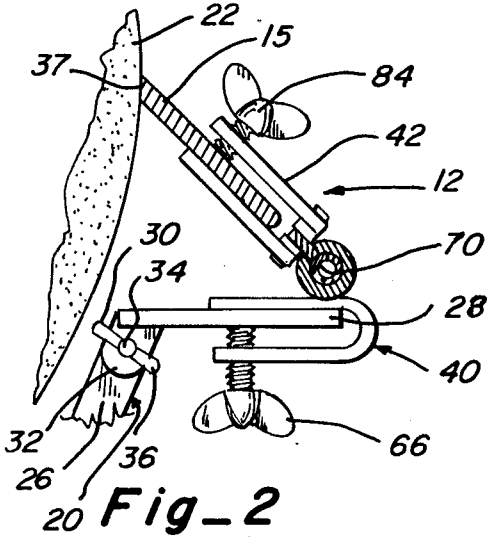
FIG. 2 is an enlarged fragmentary sectional view taken along line 2—2 in FIG. 1.

As noted in FIG. 2, the object support assembly 20 includes a base member 26 having an adjustable support plate 28 connected thereto through the use of an adjustable connector assembly 30.

The adjustable support plate 28 is of a rectangular shape being of plate material and having a laterally extended anchor lug 32 which is connected to the base member 26. The adjustable connector assembly 30 includes a bolt member 34 extended through aligned openings in the anchor lug 32 and the base member 26 and having a threaded outer end thereof on which a wing nut member 36 is positioned. It is obvious that the connector assembly 30 allows the base member 26 to be rotatably adjustable about the bolt member 34 and anchored in a desired angular position by use of the wing nut member 36 in order to place the support plate 28 in a proper relationship relative to the rotating grinder wheel 22.

The lawn mower blade 15 is of a generally conventional nature including a central anchor section 33 with integral outer blade sections 35. The central anchor section 33 is provided with a plurality of openings for attachment in a conventional manner to a powered lawn mower. The outer blade sections 35 are provided with edge portions 37 which are adapted to be sharpened through the use of the lawn mower blade sharpener apparatus 12 of this invention.

The lawn mower blade sharpener apparatus 12 includes a stationary grinder attachment assembly 40 connectable to the bench grinder assembly 14 and a pair of movable blade attachment assemblies 42, 44 connectable to opposite ends of the lawn mower blade 15 and movable within the stationary grinder attachment assembly 40 as will be explained.

Figure 4:
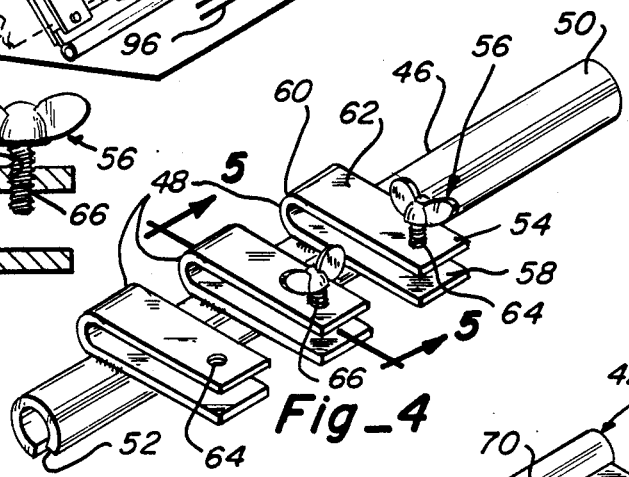
FIG. 4 is a perspective view of a stationary grinder attachment assembly of the lawn mower blade sharpener apparatus of this invention.

As noted in FIG. 4, the stationary grinder attachment assembly 40 includes a main support tube 46 having a plurality, namely three, grinder clamp members 48 connected thereto. The main support tube 46 is of cylindrical shape in transverse cross section and having a main body section 50 with an axial slot section 52 extended the entire length thereof.

Each grinder clamp member 48 includes a "U" shaped clamp body 54 having an anchor member 56 mounted thereon. Each "U" shaped clamp body member 54 includes a top wall 58 integral with an intermediate wall 60 which, in turn, is integral with a bottom wall 62. The bottom wall 62 is provided with a threaded opening 64 to receive a respective anchor member 56 therein.

Each anchor member 56 includes a wing bolt member 66 adapted to be threaded within respective threaded openings 64. For reasons of clarity, only two of the wing bolt members 66 are illustrated in FIG. 4 but it is obvious that each of the threaded openings 64 are adapted to receive a wing bolt member 66 therein for clamping against a bottom surface of the adjustable support plate 28.

Figure 6:
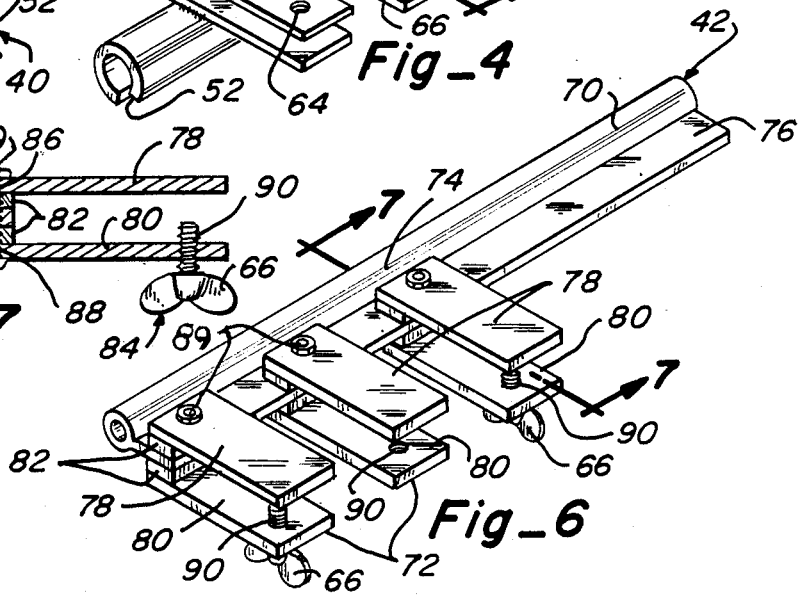
FIG. 6 is a perspective view of a movable blade attachment assembly of the lawn mower blade sharpener apparatus of this invention.

The movable blade attachment assemblies 42, 44 are identical and, therefore, only one need be described in detail. As noted in FIG. 6, the movable blade attachment assembly 42 includes a main support rod 70 having a plurality, namely three, blade connector clamps 72 connected thereto. The main support rod 70 is of tubular shape in transverse cross section having a tubular shaped rod body 74 and an anchor flange 76 extended laterally from one side thereof. The anchor flange 76 is a plate member operable (1) for sliding, telescoping movement within the slot section 52 of the stationary grinder attachment assembly 40; and (2) to have the blade connector clamps 72 secured to one end portion thereof.

Figure 7:
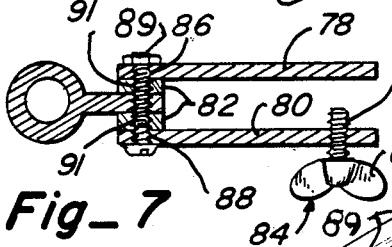
FIG. 7 is an enlarged sectional view taken along line 7—7 in FIG. 6.

The blade connector clamps 72 are identical and, therefore, only one needs to be described in detail. Each blade connector clamp 72 includes a first plate member 78; a second plate member 80; spacer plate members 82; and anchor members 84. The first and second plate members 78, 80 are of a generally rectangular plate shape adapted to be placed in a spaced relationship against respective ones of the spacer plate members 82 as noted in FIG. 7.

The first plate member 78 has a connector hole 86; the second plate member 80 has a connector hole 88 and a threaded hole 90; and the spacer plate members 82 have connector holes 91. The holes 86, 88, and 91 are axially aligned to receive nut and bolt anchor members 89 therewithin for clamping purposes.

The anchor members 84 are identical wing bolt members 66 which are adapted to be threadably placed within the respective threaded holes 90 in the second plate member 80. The wing bolt members 66 are operable to clamp onto the respective outer blade sections 35 of the lawn mower blade 15 as noted in FIG. 1. Although in FIG. 1 only two of the wing bolt members 66 are shown as connected to the outer blade sections 35, it is obvious that a total of six (6) of the wing bolt members 66 could be utilized, as deemed necessary, for rigidity in connecting to the lawm mower blade 15.

USE AND OPERATION OF THE INVENTION

In the use and operation of the invention, it is noted that the lawn mower blade sharpener apparatus 12 is utilized with the bench grinder assembly 14 which can be driven by an electric motor, a gasoline engine, or even a foot powered, rotatable grinder wheel 22. The main object of this invention is to provide a lawn mower blade sharpener apparatus 12 which can be connected in a fixed position relative to the rotating grinder wheel 22 for a blade sharpening function.

First, the stationary grinder attachment assembly 40 is attached to a support element such as the object support assembly 20 of the bench grinder assembly 14 by placing the grinder clamp members 48 about the adjustable object support plate 28 of the object support assembly 20. The U-shape clamp body 54 is placed about the adjustable support plate 28 and the wing bolt members 66 are tightened thereupon to achieve a clamped relationship.

Next, it is noted that the movable blade attachment assemblies 42, 44 are attached to outer respective ends of the blade sections 35 of the lawn mower blade 5. The blade connector clamps 72 are placed about a portion of the lawn mower blade 15 between the central anchor section 33 and the respective outer blade sections 35. The anchor members 84 are thereupon rotated within the threaded holes 90 in the second plate member 80 to achieve a desired clamping action. It is noted that two of the identical, movable blade attachment assemblies 42, 44 are provided so that the blade sharpening function can proceed rapidly without requiring detachment from the lawn mower blade 15.

Figure 3:
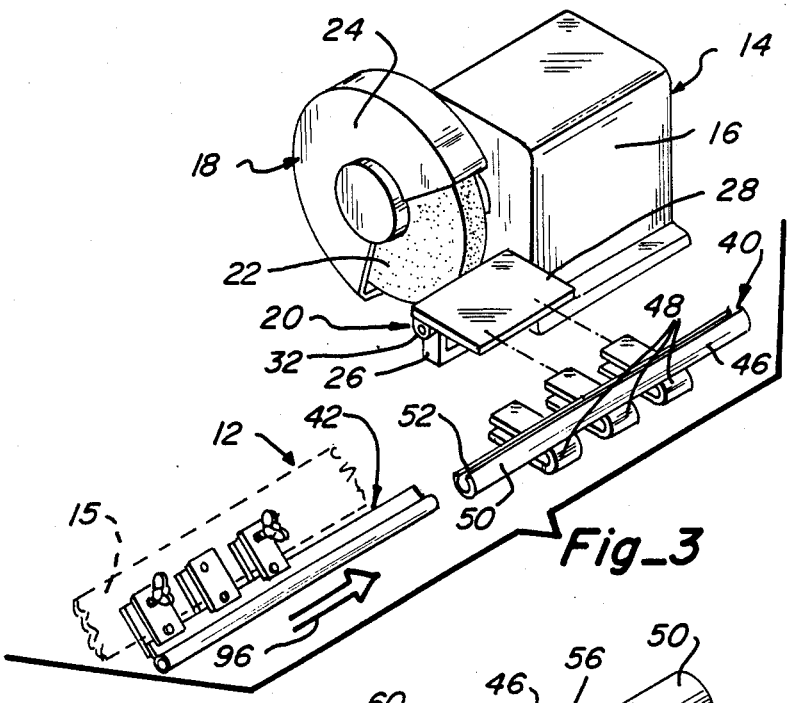
FIG. 3 is an exploded perspective view of a major portion of the lawn mower blade sharpener apparatus of this invention illustrating a proposed connection to an object support assembly of the bench grinder assembly.
Figure 5:
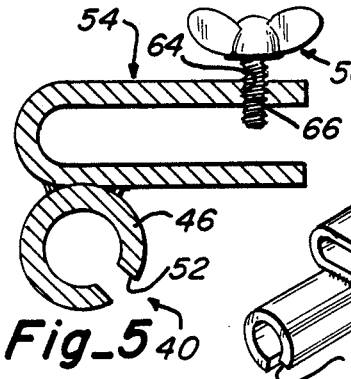
FIG. 5 is an enlarged sectional view taken along line 5—5 in FIG. 4.

As noted in FIG. 3 with the lawn mower blade 15 having the movable blade attachment assemblies 42, 44 connected thereto, the rod body 74 is axially aligned with the main body section 50 and moved axially as noted by arrow 96 within the main body section 50. It is noted that the outer diameter of the rod body 74 is slightly less than the inner diameter of the main body section 50 to allow for longitudinal sliding movement. Additionally, the thickness of the anchor flange 76 is slightly less than that of the slot section 52 so as to achieve proper axial and angular longitudinal movement of the respective movable blade attachment assemblies 42, 44 within the main support tube 46 of the stationary grinder attachment assembly 40.

The object support assembly 20 is operable through the adjustable connector assembly 30 so as to move the support plate 28 to a desired angular relationship to place an edge portion 37 of an outer blade section 35 of the lawn mower blade 15 in a proper angular relationship for a sharpening function as noted in FIG. 2. When achieving the proper angular relationship, it is obvious that the wing nut member 36 on the bolt member 34 is tightened to anchor same in the proper angular relationship.

On starting a blade sharpening function, it is obvious that the bench grinder assembly 14 is energized to rotate the grinder wheel 22 as noted by arrow 23 in FIG. 1. Concurrently, it is noted that the angular adjustment of the lawn mower blade 15 relative to the grinder wheel 22 is indicated by the arrow 92. In proceeding with a blade sharpening function, it is obvious that the movable blade attachment assembly 42 is movable longitudinally within the main support tube 46 as noted by arrow 94 in FIG. 1.

After achieving a blade sharpening function on one of the outer blade sections 35 through the use of the movable blade attachment assembly 42 as noted in FIG. 1, it is obvious that the lawn mower blade 15 with the movable blade attachment assemblies 42, 44 attached thereto can be moved out of engagement with the stationary grinder attachment assembly 40 and rotated substantially 180 degrees. The movable blade attachment assembly 44 is then placed within the main support tube 46 as previously described for the movable blade attachment assembly 42 and a blade sharpening function on the other one of the outer blade sections 36 can be achieved as previously described.

It is noted that further sharpening of the lawn mower blade 15 can be achieved with additional adjustment of the object support assembly 20 as noted by the arrow 92. There can be some play provided between the slot section 52 and the anchor flange 76 so as to allow pivotal movement of the respective movable blade attachment assemblies 42, 44 during the blade sharpening operation as noted by the arrow 92.

Additionally, the lawn mower blade sharpening apparatus of this invention is easily attachable to both lawn mower blades and bench grinder assemblies to achieve a new, novel, and accurate sharpening function over the known prior art structures.

The lawn mower blade sharpener apparatus of this invention is easy to operate; economical to manufacture; substantially maintenance free; and provides a safe, effective, and efficient method of sharpening lawn mower blades.

While the invention has been described in conjunction with preferred embodiments thereof, it will be understood that this description is intended to illustrate and not to limit the scope of the invention, which is defined by the following claims.

I claim:

1. A lawn mower blade sharpener apparatus connectable to a blade member and a support plate on a bench grinder assembly to achieve a blade edge sharpening operation, comprising:

(a) a stationary grinder attachment assembly connected to the support plate on the bench grinder assembly;

(b) a movable blade attachment assembly connected to the blade member and mounted on said stationary grinder attachment assembly for reciprocal longitudinal movement;

(c) said stationary grinder attachment includes a main support tube having grinder clamp members secured thereto;

(d) said main support tube having a cylindrical main body section and a slot section extended the length of said main body section;

(e) said movable blade attachment assembly having a main support rod with blade connector clamps thereon;

(f) said main support rod includes a laterally extended anchor flange;

(g) said main support rod mounted in said main body section for longitudinal and reciprocal movement therein;

(h) said anchor flange slidably engages said slot section on said main support tube to limit movement thereof longitudinally and prevent rotational movement of said movable blade attachment assembly when mounted within said stationary grinder attachment assembly; and (i) said blade connector clamps are of generally U-shape including a first plate member; a second plate member; and spacer plate members clamped against said anchor flange by a connector member and having an anchor member mounted within said second plate member and engagable with the blade member for releasably connecting same thereto for the blade edge sharpening operation;

whereby said movable blade attachment assembly holds a blade edge of the blade member at a proper angle relative to a grinder wheel of the bench grinder assembly and reciprocates within said stationary grinder attachment assembly to achieve the sharpening operation the entire length of the blade edge.

* * * * *